United States Patent [19]

Mohr et al.

[11] Patent Number: 4,920,823

[45] Date of Patent: May 1, 1990

[54] ROTARY KNOB FOR CONTROL DEVICES OR THE LIKE

[75] Inventors: Michael A. Mohr, Saarlouis-Roden; Günter W. W. Koglin, Altleiningen, both of Fed. Rep. of Germany

[73] Assignee: U.S. Philips Corporation, New York, N.Y.

[21] Appl. No.: 306,365

[22] Filed: Feb. 3, 1989

[30] Foreign Application Priority Data

Feb. 5, 1988 [DE] Fed. Rep. of Germany ..... 3803356

[51] Int. Cl.[5] ..... G05G 1/10

[52] U.S. Cl. ..... 74/553; 16/121

[58] Field of Search ..... 74/553; 16/121

[56] References Cited

U.S. PATENT DOCUMENTS

| | | | |
|---|---|---|---|
| 2,541,892 | 2/1951 | Schulze | 16/121 X |
| 3,303,717 | 2/1967 | Valenti | 74/553 |
| 3,318,169 | 5/1967 | Tronslien | 74/553 X |
| 3,410,247 | 11/1968 | Fromberger | 74/553 X |
| 3,503,586 | 3/1970 | Bordes | 74/553 X |
| 4,016,387 | 4/1977 | Aberer . | |
| 4,135,471 | 1/1979 | Wooldridge | 74/553 X |

FOREIGN PATENT DOCUMENTS

| | | |
|---|---|---|
| 1472314 | 9/1970 | Fed. Rep. of Germany . |
| 2250621 | 4/1974 | Fed. Rep. of Germany . |
| 2130438A | 11/1982 | United Kingdom . |

*Primary Examiner*—Rodney M. Lindsey
*Attorney, Agent, or Firm*—Brian J. Wieghaus

[57] ABSTRACT

In known rotary knobs, an intermediate part and a universal joint are arranged between a base member and a switching handle that can be connected thereto for compensating position deviations between the longitudinal axes of the base member of the rotary knob and of an actuation shaft of a control device or the like. The new rotary knob can be manufactured and mounted in a simplified manner and can satisfactorily compensate for position deviations. The switching handle can be connected to the base member essentially so as to be locked against rotation and the base member has a bearing part with snapping means for a connection with a housing part. The rotary knob can be used, for example, on front sides or operating desks of domestic apparatuses or for operating program control devices.

19 Claims, 3 Drawing Sheets

ROTARY KNOB FOR CONTROL DEVICES OR THE LIKE

BACKGROUND OF THE INVENTION

The invention relates to a rotary knob for control devices or the like comprising a bearing part for a rotatable journalling in a housing part, a base member body which is locked against rotation and can be connected to an actuation shaft of the control device and a switching handle which can be connected to this member through a first snap connection. In a rotary knob of the said kind (DE-GM No. 82 31 565.5), the switching handle has a cylindrical section held in a bearing formed at the housing part. The housing part, into which the rotary knob is sunk to a great extent, can then be a front wall of a domestic apparatus or a part of an operating desk. The switching handle is connected to the base member through an intermediate part and a universal joint. Through the universal joint, the switching handle is connected so as to be locked against rotation to the base member and hence to the actuation shaft of the control device; it should permit a compensation of position deviations. The known rotary knob requires a large number of components and hence a large amount of manufacturing and mounting labour. Further, additional measures are required to lock the rotary knob against a movement in axial direction, for example a removal by unqualified persons, such as children or the like.

SUMMARY OF THE INVENTION

The invention has for its object to construct a rotary knob of the kind mentioned in such a manner that it can be manufactured and mounted in a simple manner, can be arranged in a flexible manner and is locked against displacements in the axial direction.

According to the invention, this object is achieved in a rotary knob of the kind mentioned in that the switching handle and the base member can be essentially interconnected so as to be locked against rotation and in that the bearing part comprises snapping means for a second snap connection and is formed at the base member.

Due to the fact that the switching handle and the base member are interconnected so as to be locked against rotation, additional components for this purpose are not required. Due to the fact that the bearing part comprises snapping means for a second snap connection and is formed at the base member, the latter can be connected in a simple manner to the housing part independently of the switching handle. Due to the second snap connection, a movement of the rotary knob in axial direction can be limited in a simple manner. Thus, a rotary knob is prevented in a simple manner from being pulled out of the housing part and off the actuation shaft of the control device unintentionally and in an unqualified manner. The second snap connection and the bearing part can be formed with clearance with respect to the housing part in such a manner that position deviations with regard to the longitudinal axis of the rotary knob and the actuation shaft can be compensated for.

Due to the fact that the base members can initially be connected to housing parts without a switching handle. switching handles may be arranged, for example, only after a transport; therefore, they can be protected to a great extent from transport damage. Further, simplifications are obtained in that differently shaped switching handles can be connected to equally constructed base members. Thus, the variation possibilities can be enlarged and a multiple of components can be reduced, respectively.

In a preferred embodiment, the second snap connection has for partwise receiving the housing part snapping hooks and abutment stops arranged at a certain distance therefrom. Thus, an intermediate space for partwise receiving housing parts is obtained in a simple manner.

In a rotary knob comprising a base member having a first hub for receiving an end section of the actuation shaft, it has proved to be advantageous that the switching handle has a second hub for receiving the first hub. A connection locked against rotation between the switching handle and the actuation shaft can be manufactured and mounted in a simple manner.

It has further proved to be advantageous that the end section of the actuation shaft is flattened and that the first and the second hub each time has correspondingly flattened parts. Thus, a connection locked against rotation is obtained in a particularly simple and reliable manner.

It is further advantageous that the first hub has a receiving area in the form of a blind hole. Thus, the housing part is essentially terminated with respect to the control device after a base member has been arranged. The length of the receiving area in the form of a blind hole can then be determined so that deviations with regard to the position of the actuation shaft can be compensated for. Deviations in the axial direction of the actuation shaft can be compensated for by displacing the actuation shaft in the hub.

In a further preferred embodiment, the first and/or second snap connection have three snapping hooks. Snap connections can thus be manufactured in a simple and reliable manner.

It is further advantageous that perforations for the second snap connection are formed at the base member radially adjacent to the snapping hooks. Thus, the flexibility of snapping hooks can be increased in a simple manner.

In a further preferred embodiment, the switching handle has a section in the form of a hollow cylinder for partwise receiving the base member. Thus, after switching handles have been arranged in the base member, a termination of the rotary knob with respect to the housing part and hence also with respect to the control device as well as its electrical control leads can be obtained in an optically conspicuous and reliable manner.

It has further proved to be advantageous that the base member and/or the switching handle are made in one piece; they can be manufactured in a simple manner from synthetic material, for example by injection moulding.

It is advantageous that a base member for a rotary knob according to one or several of the said features has a bearing part with snapping means for a second snap connection.

BRIEF DESCRIPTION OF THE DRAWINGS

In order that the invention may be readily carried out, it will be described more fully, by way of example, with reference to the accompanying drawing, in which.

DESCRIPTION OF THE PREFERRED EMBODIMENT

Figure 1:
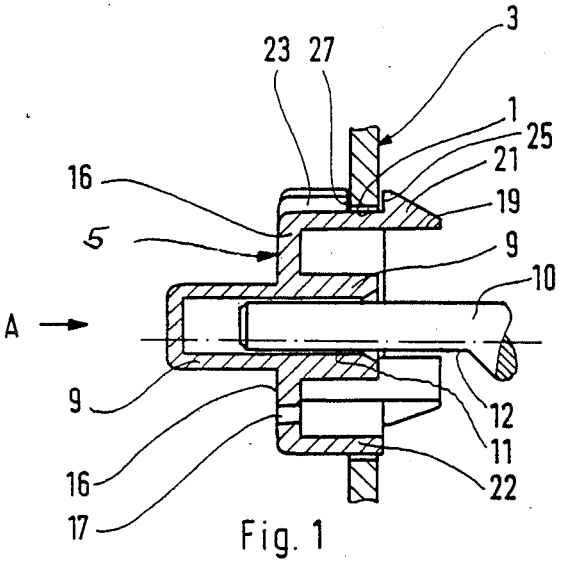
FIG. 1 is a longitudinal sectional view of a base member according to the invention.
Figure 2:
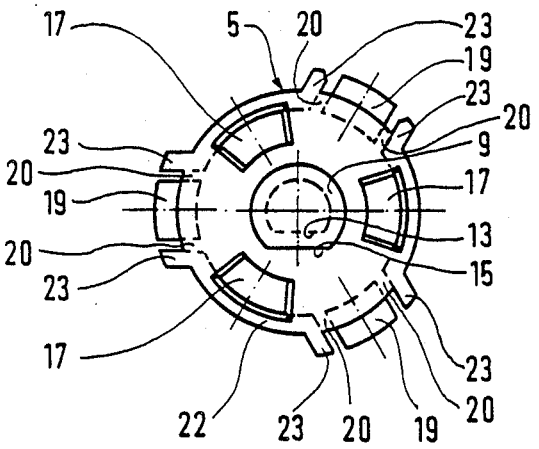
FIG. 2 is a front elevation of the base member in the direction A according to FIG. 1.

As shown in FIG. 1, a base member 5 of a rotary knob designated as a whole by reference numeral 7 (FIG. 5) is arranged in an opening 1 of a housing part 3 shown incompletely. The housing part 3 may form part, for example, of a front wall of a domestic apparatus or of an operating desk.

The base member 5, which can be manufactured in one piece from synthetic material, for example by injection moulding, has a first hub 9 terminated by a blind hole for receiving an end part of an actuation shaft 10 (shown incompletely) of a control device not shown, for example of a program control device of a washing machine or dish washer or of a rotary switch. For a connection locked against rotation with the actuation shaft, a hub bore 11 has a flattened part 13, which is adapted to an also flattened part 12 of the actuation shaft 10. In order to compensate for manufacturing and mounting deviations with regard to the position of the actuation shaft 10, the end section thereof is arranged in the hub bore 11 in the form of a part for receiving the hub 9 so as to be displaceable in the axial direction.

The hub 9 is provided—with a substantially equal wall thickness, also with regard to its generated surface—with a flattened part 15.

From an intermediate part of the hub 9, a disk-shaped intermediate part 16 extends radially outwards and substantially at right angles to a center axis of the hub 9. Three segment-shaped perforations 17 are formed in the intermediate part 16 at the same relative distance. Three snapping hooks 19, which are arranged radially outwards from the perforations 17 and substantially at the same respective distance from adjacent perforations 17, extend from the intermediate part 16.

In the present embodiment, the three snapping hooks 19 are each time separated by axially extending slots 20 from a shoulder 22 in the form of a hollow cylinder having the same outer and inner diameters. At the free end of each snapping hook 19, a snapping nose 21 is formed, which projects in longitudinal direction and radially outwards from the shoulder 22. Each of the elastic snapping hooks 19 is arranged between and at a certain distance from two longitudinal ribs 23. Each longitudinal rib 23 is formed in the proximity of a slot 20 at the shoulder 22. The longitudinal ribs 23 project form the shoulder 22 radially outwards in accordance with the snapping noses 21. Each longitudinal rib 23 then extends axially from the intermediate part 16 and terminates at a certain distance from the snapping noses 21 so that an intermediate space for receiving a part of the housing part 3 limiting the opening 1 is formed between engagement surfaces 25, 27 of the snapping noses 21 and of the longitudinal ribs 23, respectively, arranged opposite to each other and substantially at right angles to the centre axis of the hub 9.

Due to the fact that, after the fundamental body 5 has been inserted into the opening 1, resilient snapping noses 21 engage behind the housing part 3, the fundamental body 5 is prevented from being unintentionally detached from the housing part 3. A movement of the fundamental body 5 into the housing part is prevented by the longitudinal ribs 23 constituting an abutment stop.

It is ensured that the fundamental body 5 can perform a rotary movement in the opening 1 by corresponding adaptation of the radially outer generated surfaces of the shoulder 22 and of the snapping hooks 19 to the diameter of the opening 1 and by a distance between the engagement surfaces 25, 27 chosen to be correspondingly large. The part of the generated surfaces of the shoulder 22 and of the snapping hooks 19 located between the engagement surfaces 25, 27 then constitutes a bearing part with respect to an inner wall of the opening 1.

Both during the incorporation of a fundamental body 5 in a housing part 3 and during the use of a rotary knob 7, the parts of the snapping hooks 19 forming part of the hearing part are protected from excessive load by the parts of the shoulder 22 forming the other part of the bearing part. An amount of clearance can be determined between the shoulder 22, the snapping hooks 19 and the opening 1 in such a manner that deviations with regard to the position of the opening 1 and of the actuation shaft 10 of the control device fixedly arranged in the housing part 3 can be compensated for by means of a change of position of the base member 5 in the opening 1. A compensation of position deviations in axial direction is possible in that, as shown in FIGS. 1 and 5, after the base member 5 has been connected to the actuation shaft 10, a distance exists between its free end and the termination of the hub bore 11 and the actuation shaft 10 is received in the hub bore 11 so as to be displaceable.

The base member 5 can therefore be connected in a simple manner through the second snap connection comprising snapping hooks 19 and longitudinal ribs 23 to the housing part 3 before a complete rotary knob 7 is inserted. The opening 1, except the perforations 17, is terminated with respect to the interior of the housing part 3 after the base member 5 has been inserted.

Figure 3:
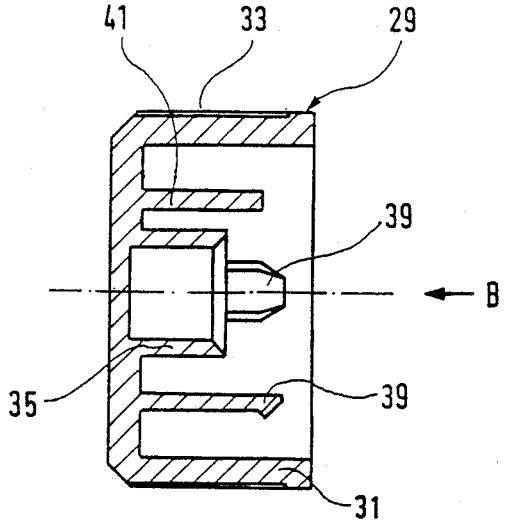
FIG. 3 is a longitudinal sectional view of the switching handle according to the invention.
Figure 4:
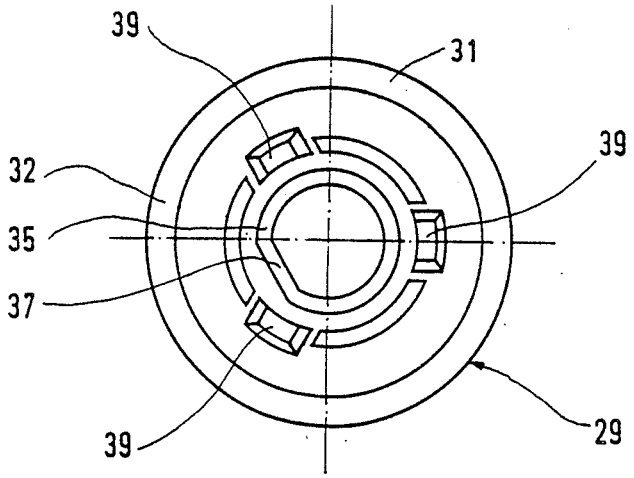
FIG. 4 is a front elevation of the switching handle in the direction B according to FIG. 3.
Figure 5:
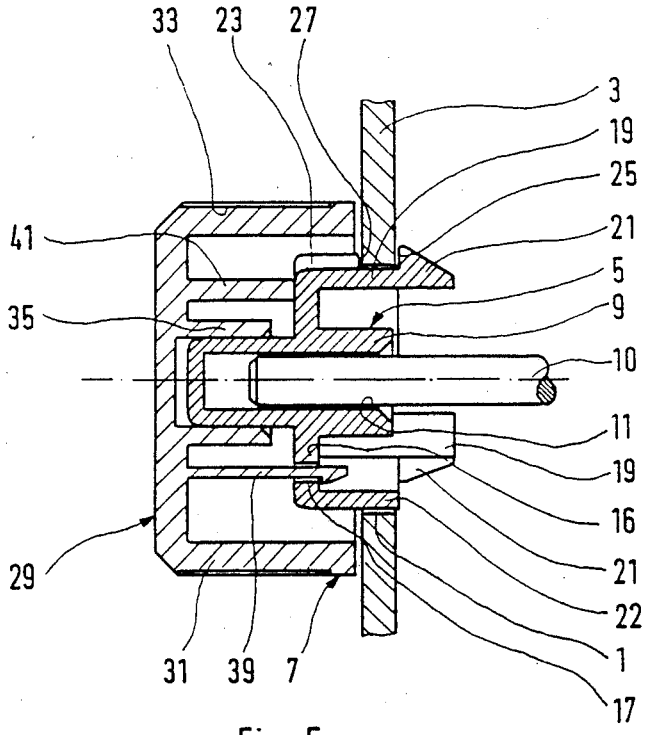
FIG. 5 is a longitudinal sectional view of an assembled rotary knob.

During a second step, for example after transport and before delivery, a switching handle 29 can be connected to a base member 5 in order to complete the assembly of a rotary knob 7; this switching handle is shown separately in the FIGS. 3 and 4; and FIG. 5 shows the assembled switching handle and base member 5. The switching handle has a mainly cup-like shape with a unilaterally closed hollow-cylindrical section 31 for partly receiving the base member 5. The switching handle 29 may be shaped independently of the base member 5; in order to ensure a suitable grip, the surface 33 of the hollow-cylindrical portion 31 is, for example knurled. In order to ensure that the connection between the base member 5 and the switching handle 29 is locked against rotation, the switching handle is provided with a second hub 35 for accepting the first hub 9, the second hub having a cross-section which is adapted to that of the first hub and which comprises a portion 37 which is flat on the inside as well as the outside.

For the connection to the base member 5 the switching handle 29 also comprises three snapping hooks 39 which extend in the longitudinal direction, parallel to the second hub 35 and beyond, and which can be passed through the perforations 27 for connection. As is shown in FIG. 5, they then engage behind the intermediate piece 16, thus forming a first snap connection. In order to locate the switching handle 29 in the axial direction and to ensure that a clearance exists with respect to the outer surface of the housing part 3 in the assembled condition, the switching handle 29 is provided with projections 41 which extend radially outwards to the second hub 35 and parallel thereto and which form an abutment for the intermediate piece 16. The rotary knob can thus be turned while precluding contact between the switching handle 29 and the housing part 3, influencing of the function of the switching handle thus also being precluded.

The second snap connection, i.e. the connection of the base member 5 to the housing part 3, can be realised by constructing the snap hooks 19 to be more rigid than the snap hooks 39 of the first snap connection so that it is more difficult to disengage the second snap connection than the first snap connection. Forces exerted for disengagement thus result first of all in the removal of the switching handle 29. In this condition, the base member 5 keeps the interior of the housing part 3, containing electrical connections, substantially closed, thus preventing inadmissible access.

We claim:

1. A rotary knob, comprising:

a base member, said base member comprising a first hub having a first bore therein for receiving an end section of an actuation shaft and a bearing portion comprising first snapping means for rotatably securing said base member in a circular opening of a control panel with said first hub receiving the actuation shaft; and a switching handle for connection to said base member, said switching handle comprising a second hub having a second bore therein for receiving said first hub, said second bore and the outer surface of said first hub comprising locking means for locking said switching handle and base member against relative rotation.

2. A rotary knob as claimed in claim 1, wherein said first snapping means comprises a plurality of snapping hooks each having radially extending noses and said bearing portion comprises a plurality of abutment stops spaced axially from said noses a distance at least equal to the thickness of the control panel.

3. A rotary knob as claimed in claim 2, wherein for an actuation shaft having an end section having an axially extending flat, said first bore has a corresponding flat for locking said base member and shaft against relative rotation.

4. A rotary knob as claimed in claim 3, wherein said locking means comprises the outer surface of said first hub having an axially extending flat and said second bore having a corresponding flat for locking said first and second hubs against relative rotation.

5. A rotary knob as claimed in claim 4, wherein said first hub and bore have a length from said bearing portion chosen for receiving actuation shafts protruding from the control panel with a varying length.

6. A rotary knob as claimed in claim 5, wherein said base member and said switching handle comprise second snapping means for detachably securing said switching handle to said base member.

7. A rotary knob as claimed in claim 6, characterized in that the first and second snapping means each have three snapping hooks.

8. A rotary knob as claimed in claim 7, wherein said second snapping means comprises said three snapping hooks being on said switching handle and said base member having three perforations for lockingly receiving said switching handle snapping hooks, said perforations being located radially adjacent to said three snapping hooks of said first snapping means.

9. A rotary knob as claimed in claim 8, characterized in that the base member and the switching handle are each made in one piece.

10. A rotary locking knob as claimed in claim 2, wherein said base member and said switching handle comprise second snapping means for detachably securing said switching handle to said base member.

11. A rotary knob as claimed in claim 10, characterized in that the first and second snapping means each have three snapping hooks.

12. A rotary knob as claimed in claim 11, wherein said second snapping means comprises said three snapping hooks being on said switching handle and said base member having three perforations for lockingly receiving said switching handle snapping hooks, said perforations being located radially adjacent to said three snapping hooks of said first snapping means.

13. A rotary locking knob as claimed in claim 1, wherein said base member and said switching handle comprise second snapping means for detachably securing said switching handle to said base member.

14. A rotary knob as claimed in claim 13, characterized in that the first and second snapping means each have three snapping hooks.

15. A rotary knob as claimed in claim 14, wherein said second snapping means comprises said three snapping hooks being on said switching handle and said base member having three perforations for lockingly receiving said switching handle snapping hooks, said perforations being located radially adjacent to said three snapping hooks of said first snapping means.

16. A rotary knob as claimed in claim 1, wherein for a shaft having an end section having an axially extending flat, said first bore has a corresponding flat for locking said base member and shaft against relative rotation.

17. A rotary knob as claimed in claim 1, wherein said locking means comprises the outer surface of said first knob having an axially extending flat and said second bore having a corresponding flat for locking said first and second hubs against relative rotation.

18. A rotary knob as claimed in claim 1, characterized in that the base member and switching handle are each made in one piece.

19. A rotary knob as claimed in claim 4, wherein said first hub and bore have a length from said bearing portion chose for receiving shafts protruding from the control panel with varying length.

* * * * *